US009901132B2

(12) United States Patent
Hairston

(10) Patent No.: US 9,901,132 B2
(45) Date of Patent: Feb. 27, 2018

(54) HEAD COVERING ARTICLE

(71) Applicant: Celento Hairston, Jonesboro, GA (US)

(72) Inventor: Celento Hairston, Jonesboro, GA (US)

( * ) Notice: Subject to any disclaimer, the term of this patent is extended or adjusted under 35 U.S.C. 154(b) by 0 days.

(21) Appl. No.: 14/613,587

(22) Filed: Feb. 4, 2015

(65) Prior Publication Data

US 2016/0219960 A1 Aug. 4, 2016

(51) Int. Cl.
*A42B 1/04* (2006.01)

(52) U.S. Cl.
CPC ..... *A42B 1/041* (2013.01)

(58) Field of Classification Search
CPC ..... A41B 1/04; A41B 1/041; A42B 1/041; A42B 1/066; A42B 1/241
See application file for complete search history.

(56) References Cited

U.S. PATENT DOCUMENTS 1,610,480 A * 12/1926 Seilaz ..... A45D 8/40 132/274
1,697,919 A * 1/1929 Knepper ..... 2/171
1,907,709 A * 5/1933 Barrow ..... 2/171
2,193,271 A * 3/1940 Cowherd ..... 2/171
2,783,474 A * 3/1957 Campagna ..... A41D 20/00 2/171
3,618,140 A * 11/1971 Goldfarb ..... A42B 1/045 2/207
4,698,852 A * 10/1987 Romero ..... 2/171
4,947,488 A * 8/1990 Ashinoff ..... 2/181
5,377,360 A * 1/1995 Fleitman ..... 2/181
5,878,756 A * 3/1999 Bilodeau ..... 132/274
5,946,734 A * 9/1999 Vogan ..... 2/412
6,438,761 B1 * 8/2002 McGarrity ..... 2/410
6,565,461 B1 * 5/2003 Zatlin ..... 473/446
6,735,783 B2 * 5/2004 Phillips ..... 2/202
6,738,986 B1 * 5/2004 Martin ..... 2/207
7,096,510 B2 * 8/2006 Yeadon ..... 2/202
D617,980 S * 6/2010 Guinyard ..... D2/880
D636,153 S * 4/2011 Schrab ..... D2/881
2007/0050887 A1 * 3/2007 Leguenec ..... 2/171

* cited by examiner

*Primary Examiner* — Richale Quinn
(74) *Attorney, Agent, or Firm* — Incorporating Innovation LLC; Charlena Thorpe, Esq.

(57) ABSTRACT

Implementations of a head covering article are provided. The head covering article includes an edge portion configured to rest on a wearer's forehead and a pad configured to cover a portion of the wearer's forehead. In some implementations, the bottom edge of the pad is aligned with a portion of the edge portion of the material to create a padded edge portion. In some implementations, the corners of the pad are rounded. Either of these implementations may reduce or prevent impressions from being formed horizontally across the wearer's forehead.

15 Claims, 2 Drawing Sheets

HEAD COVERING ARTICLE

TECHNICAL FIELD

This disclosure relates to implementations of a head covering article.

BACKGROUND

Head covering articles such as wave caps, "do-rags", head scarves, bandanas, etc. are worn for a variety of reasons. These head covering articles are typically secured about a wearer's head by extending a portion of the head covering article down over a portion of the wearer's forehead and tying a portion of the article in the back of the head. Oftentimes, these head covering articles are worn for an extended period of time (e.g., overnight while the wearer is sleeping). This extended wear time along with the pressure exerted on the forehead from typing the head covering about the head can cause the edge of the head covering article resting on the wearer's forehead to leave a horizontal impression across the wearer's forehead. This impression can be visible when the head covering article is removed and can last for an extended period of time.

U.S. Patent Pub. No. 2011/0247126 and U.S. Patent Pub. No. 2008/0307561 concern head covering articles and the impression caused by these articles. However, the head covering articles disclosed in these publications do not address the impression that can extend horizontally across a wearer's head caused by the edge of the head covering article resting on the forehead.

DETAILED DESCRIPTION

Implementations of a head covering article are provided. The head covering article includes an edge portion configured to rest on a wearer's forehead and a pad configured to cover a portion of the wearer's forehead. In some implementations, the bottom edge of the pad is aligned with a portion of the edge portion of the material to create a padded edge portion. In some implementations, the pad comprises a ledge extending around the perimeter of the pad and a padded section extending from the ledge, wherein the corners of the padded section are rounded and a portion of the ledge is aligned with a portion of the edge portion of the material. In some implementations, the ledge 410 or a portion thereof may include padding material. In some implementation, the ledge 410 may not include padding material. In some implementations, the head covering article can be formed as a "do rag", a wave cap, a bandana, a head scarf, or any other head covering article.

Figure 1:
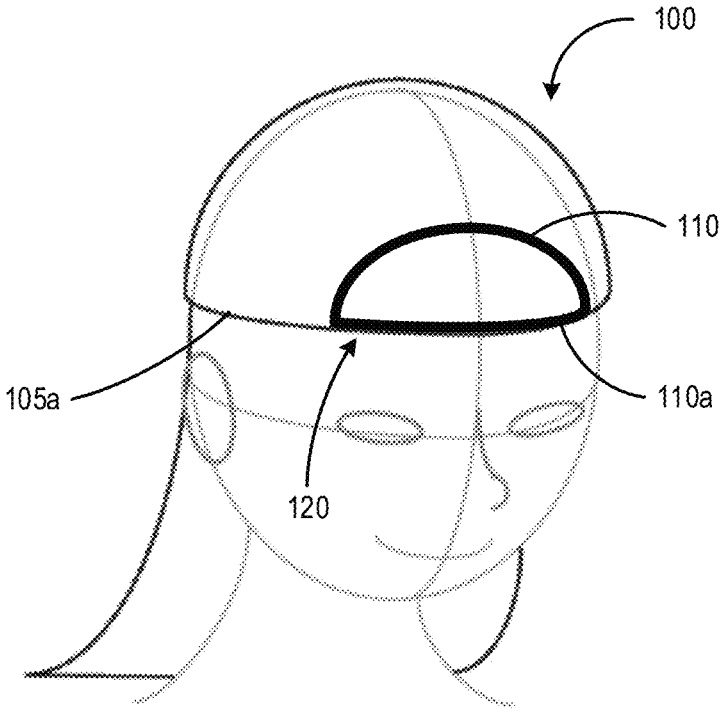
FIGS. 1 and 2 illustrate an example implementation of a head covering article according to the present disclosure.
Figure 2:
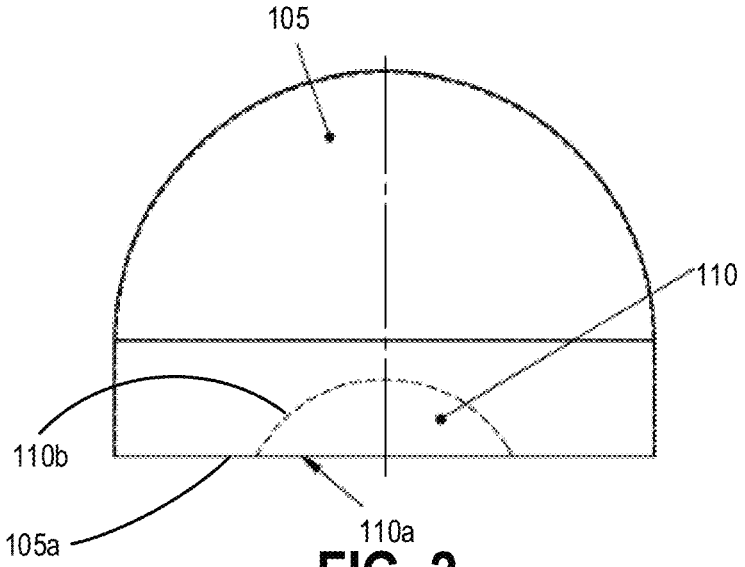

FIGS. 1 and 2 illustrate an example implementation of a head covering article 100 according to the present disclosure. In some implementations, the head covering article 100 comprises material 105 having an edge portion 105*a* intended to be placed against the forehead of a wearer and a pad 110.

In some implementations, the bottom edge of the pad 110*a* may be aligned with a portion of the edge 105*a* to create a padded edge portion 120. The padded edge portion 120 includes a portion of the edge 105*a* of material 105 and a portion 110*a* of the pad 110. In this way, a portion of the edge 105*a* making contact with the wearer's forehead is padded or cushioned. This may reduce or prevent impressions from being formed horizontally across the wearer's forehead.

In some implementation, the pad 110 may be configured to cushion a portion of the edge 105*a* of the material 105.

In some implementations, the pad 110 may include a padding material enclosed in an outer material. In some implementations, the padding material may be foam. In some implementations, the padding material may be open cell foam. In some implementations, the padding material may be cotton or any other soft material. In some implementations, the pad 110 may be manufactured from any other padding material.

Figure 4:
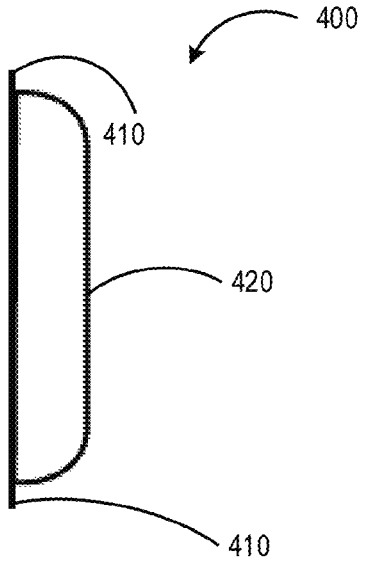
FIG. 4 illustrates a side view of an example pad according to the present disclosure.

FIG. 4 illustrates a side view 400 of an example pad 400 according to the present disclosure. As shown in FIG. 4, in some implementations, the pad 400 may include a ledge 410 extending around the perimeter of the pad 400. In some implementations, the ledge 410 may be the result of a sealing process to seal the edges of an outer material to the padding material to create the pad 400. The pad 400 further includes a padded portion 420 extending from the ledge 410. In some implementations, the corners of the padded portion 420 are rounded.

Returning to FIG. 1, with reference to FIG. 4, in some implementations, the padded edge portion 120 includes a portion of the edge 105*a* of material 105 and a portion of the ledge 410. In some implementations, the ledge 410 or a portion thereof may include padding material. In some implementation, the ledge 410 may not include padding material. In some implementations, the padded portion 420 rests on the user's forehead when the head covering article 100 is placed on the user's head. The rounded corners 420 may reduce or prevent impressions from being formed horizontally across the wearer's forehead even when the ledge 410 may not include padding material.

In some implementations, the pad may include no ledge.

In some implementations, the material 105 may be configured such that a portion of the material covers a portion of the wearer's head (e.g., as shown in FIG. 1). In some implementations, a portion of the material may be configured to cover all or a substantial portion of the wearer's hair. In some implementations, the head covering article is configured such that a portion of the material makes contact with all or substantial portion of the wearer's hair.

Figure 3:
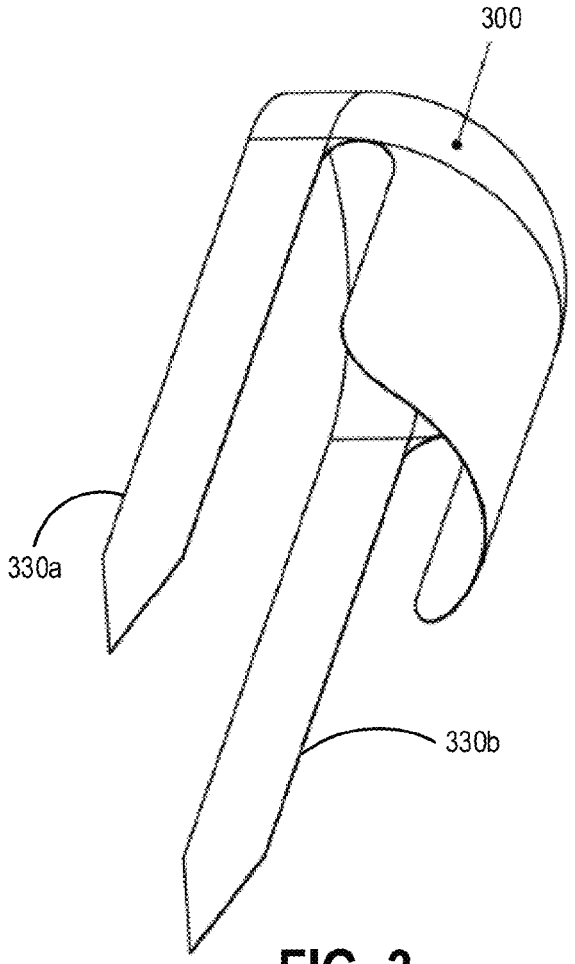
FIG. 3 illustrates another example implementation of a head covering article according to the present disclosure.

In some implementations, a portion of the material 105 comprises a pair of elongated portions to tie about the wearer's head. For example, FIG. 3 illustrates another example implementation of a head covering article 300 according to the present disclosure comprising a pair of elongated portions 330*a, b* to tie about wearer's head.

In some implementations, the material 105 can be formed as a "do rag" (see, e.g., FIGS. 1 and 3), a wave cap, a bandana, a head scarf, or any other head covering article.

In some implementations, the material 105 is stretchable. In some implementations, the material 106 is manufactured from polyester with elastane. In some implementations, the material 105 is manufactured from nylon, cotton, or any other suitable material or combination of material.

In some implementations, the pad 110 may be configured to cover a portion of the wearer's forehead. In some implementations, the pad 110 may have a straight lower portion

110*a* and a curved upper portion 110*b*. In some implementations, the pad 110 may be semi-circular. In some implementations, the pad 110 can be any shape.

In some implementation, the pad 110 may be configured to cushion a portion of the edge 105*a* of the material 105. In some implementations, the pad 110 may be manufactured from foam. In some implementations, the pad 110 may be manufactured from open cell foam. In some implementations, the pad 110 may be manufactured from cotton or any other soft material. In some implementations, the pad 110 may be manufactured from any other padding material.

In some implementations, the pad 110 may be about 3 mm in thickness. In some implementations, the pad 110 may be less than or equal to 3 mm in thickness. In some implementations, the pad 110 may be greater than 3 mm thick.

In some implementations, the pad 110 may be centered on a portion of the forehead portion of the material 105.

As mentioned above, in some implementations, the bottom edge of the pad 110*a* is aligned with a portion of the edge 105*a* to create a padded edge portion 120. In some implementations, the bottom edge of the pad 110*a* is aligned with a portion of the edge 105*a* and the pad 110 is secured to the material 105. In some implementations, a closed pocket is formed on the material 105 with the pad 110 secured within the pocket. In some implementations, the pad 110 or a portion thereof is sewn directly on a portion of the material 105.

In some implementations, a portion of the pad 110 (e.g., the bottom edge of the pad 110*a*) is sewn onto a portion of the edge 105*a* of the material 105. In some implementations, at least a portion of the pad 110 is attached to a portion of the material 105 such that a portion of the pad 110 overlaps with a portion of the edge 105*a*.

In some implementations, the pad 110 may be removably secured to the material 105. In some implementations, the pad 110 may be connected to the material 105 using hook and loop fasteners (e.g., Velcro®) or any other attachment technology. In some implementations, the pad 110 may not be attached to the material 105.

It is noted that U.S. Pat. No. 6,247,181 discloses a bandana having two-ply closed-cell foam padding designed to reduce head injuries caused by direct impact and by rotational forces among soccer players and others who would not otherwise wear head protection. However, the bandana still can form horizontal impressions across a wearer's forehead because the edge of the bandana resting on the wearer's forehead is unpadded. Furthermore, the padding in the '181 patent comes across the forehead, well around the sides, and over the top of the head. This configuration of padding would defeat the purpose of some head covering articles such as do-rags which should lay flat of wearer's hear.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A head covering article comprising:

a material comprising polyester with elastane configured to form an opening on an inner side of the head covering wherein the opening is configured to fit about a wearer's head, the material comprising a front portion, a left portion, a right portion, a middle portion, and a back portion such that when the head covering is placed on a user's head, the front portion is an anterior portion, the left portion is a left lateral portion, the right portion is a right lateral portion, the middle portion is a superior portion, and the back portion is a posterior and inferior portion, wherein the front portion comprises an edge portion extending from the left portion to the right portion and configured to rest on a wearer's forehead and wherein each of the left portion and right portion comprises a cut-out in the material thereby forming an aperture in the material between the front portion and back portion; and a pad having a defined shape with a straight lower portion and curved upper portion wherein the pad is configured to cover a portion of the wearer's forehead, wherein a portion of the front portion of the material overlies the pad and the bottom edge of the pad is aligned with the edge portion of the portion of material that overlies the pad to create a padded edge portion wherein the pad is centered on a portion of the front portion of the material and wherein the pad does not extend into the right portion and left portion of the material.

2. The head covering article of claim 1 the material is configured to cover a substantial portion of the wearer's hair.

3. The head covering article of claim 1 wherein the cut-out in the left portion and right portion of the material define a first elongated portion and a second elongated portion respectively wherein the first elongated portion and the second elongated portion aligned with the front portion on the right side and left respectively, wherein a first end of the first elongated portion and the second elongated portion are attached to the head covering on a first side and second side respectively and a remainder of the first elongated portion and the second elongated portion are detached from the back portion of the head covering and extend away from the opening, the elongated portions configured to tie about the wearer's head.

4. The head covering article of claim 1 wherein the pad comprises open cell foam.

5. The head covering article of claim 1 wherein the pad is less than or equal to 3 mm in thickness.

6. A head covering article comprising:

a material configured to form an opening on an inner side of the head covering wherein the opening is configured to fit about a wearer's head, the material comprising a front portion, a left portion, a right portion, a middle portion, and a back portion such that when the head covering is placed on a user's head, the front portion is an anterior portion, the left portion is a left lateral portion, the right portion is a right lateral portion, the middle portion is a superior portion, and the back portion is a posterior and inferior portion, wherein the front portion comprises an edge portion extending from the left portion to the right portion and configured to rest on a wearer's forehead and wherein each of the left portion and right portion comprises a cut-out in the material thereby forming an aperture in the material between the front portion and back portion; and a pad having a defined shape with a straight lower portion wherein the pad is configured to cover a portion of the wearer's forehead, wherein a portion of the front portion of the material overlies the pad and the bottom edge of the pad is aligned with the edge portion of the portion of material that overlies the pad to create a padded edge portion, wherein the pad is a single unitary piece comprising a ledge extending around the perimeter of the pad and a padded section having a thickness extending from the ledge, wherein the corners of the padded section are rounded and a portion of the ledge is aligned with a portion of the edge portion of the material and wherein the padded section extends depthwise from the ledge and inwardly toward the opening on the inner side of the head covering wherein the pad is centered on a portion of the front portion of the material and wherein the pad does not extend into the right portion and left portion of the material.

7. The head covering article of claim 6 wherein at least a portion of the ledge includes padding material and the at least a portion of the ledge including padding material is aligned with the edge portion of the portion of material that overlies the pad to create a padded edge portion.

8. The head covering article of claim 6 wherein the material is configured to cover a substantial portion of the wearer's hair.

9. The head covering article of claim 6 wherein the cut-out in the left portion and right portion of the material define a first elongated portion and a second elongated portion respectively wherein the first elongated portion and the second elongated portion aligned with the front portion on the right side and left respectively, wherein a first end of the first elongated portion and the second elongated portion are attached to the head covering on a first side and second side respectively and a remainder of the first elongated portion and the second elongated portion are detached from the back portion of the head covering and extend away from the opening, the elongated portions configured to tie about the wearer's head.

10. The head covering article of claim 6 wherein the material is stretchable.

11. The head covering article of claim 6 wherein the pad comprises open cell foam.

12. The head covering article of claim 6 wherein the pad is less than or equal to 3 mm in thickness.

13. A method of securing the head covering article of claim 6 to a head, the method comprising:

positioning the head covering article on a wearer's head such that the edge portion rest on the wearer's forehead and the portion comprising the pad covers a portion of the wearer's forehead wherein the surface of the padded section opposite the surface closet to the ledge makes contacts with the wearer's forehead.

14. The method of claim 13 wherein the head covering article further comprises a first elongated portion and a second elongated portion aligned with the front portion on the right side and left respectively, wherein a first end of the first elongated portion and the second elongated portion are attached to the head covering on a first side and second side respectively and the remainder of the first elongated portion and the second elongated portion are detached from the remainder of the head covering and extend away from the opening, the elongated portions configured to tie about the wearer's head, the method further comprising securing the head covering article to the wearer's head by tying the elongated portions about the wearer's head.

15. A head covering article comprising:

a material configured to form an opening on an inner side of the head covering wherein the opening is configured to fit about a wearer's head, the material comprising a front portion, a left portion, a right portion, a middle portion, and a back portion such that when the head covering is placed on a user's head, the front portion is an anterior portion, the left portion is a left lateral portion, the right portion is a right lateral portion, the middle portion is a superior portion, and the back portion is a posterior and inferior portion, wherein the front portion comprises an edge portion extending from the left portion to the right portion and configured to rest on a wearer's forehead and wherein each of the left portion and right portion comprises a cut-out in the material thereby forming an aperture in the material between the front portion and back portion; and a pad having a defined shape with a straight lower portion wherein the pad is configured to cover a portion of the wearer's forehead, wherein a portion of the front portion of the material overlies the pad and the bottom edge of the pad is aligned with the edge portion of the portion of material that overlies the pad to create a padded edge portion, wherein the pad is a single unitary piece comprising a ledge extending around the perimeter of the pad and a padded section having a thickness extending from the ledge, wherein the corners of the padded section are rounded and a portion of the ledge is aligned with a portion of the edge portion of the material and wherein the padded section extends depthwise from the ledge and inwardly toward the opening on the inner side of the head covering and wherein the pad is centered on a portion of the front portion of the material and wherein the pad does not extend into the right portion and left portion of the material, wherein the material comprises polyester with elastane; and the pad comprises open cell foam.

* * * * *